United States Patent [19]

Levi

[11] Patent Number: 4,746,314

[45] Date of Patent: May 24, 1988

[54] COMBINED PROPULSION AND STEERING SYSTEM FOR A MOTOR BOAT WITH AN INBOARD ENGINE

[76] Inventor: Renato Levi, Via Besana, 5, 20122 Milano, Italy

[21] Appl. No.: 870,019

[22] Filed: Jun. 3, 1986

[30] Foreign Application Priority Data

Oct. 11, 1985 [IT] Italy ..... 22495 A/85

[51] Int. Cl.[4] ..... B63H 5/06

[52] U.S. Cl. ..... 440/66; 114/148; 440/61

[58] Field of Search ..... 114/148-151, 114/144 R, 147; 440/49, 53, 61, 66, 67; 416/237, 242, 243, 228

[56] References Cited

U.S. PATENT DOCUMENTS 2,916,005 12/1959 Parsons ..... 440/66
3,768,432 10/1973 Spaulding ..... 440/67
4,046,097 9/1977 Hornung ..... 440/67
4,364,712 12/1982 Charles ..... 416/237 R
4,553,945 11/1985 Foster ..... 440/66
4,618,313 10/1986 Mosiewicz ..... 416/237

*Primary Examiner*—Joseph F. Peters, Jr.
*Assistant Examiner*—Clifford T. Bartz
*Attorney, Agent, or Firm*—Bucknam and Archer

[57] ABSTRACT

A combined propulsion and steering system for motor boats with inboard engines comprises a propeller shaft projecting from the lower part of the transom of the boat and carrying a semi-submerged propeller screw which is enclosed by an arch-like deflector tunnel extending over and to the sides of the said propeller screw and turnable about a substantially vertical axis. The ratio (L/D) between the distance (L) from the rear part of the propeller screw to the lower rear part of the transom hull and the outer diameter (D) of the propeller screw lies between 0.8 and 1.8. There is also provided an engine exhaust gas duct, forwardly of said propeller screw.

3 Claims, 2 Drawing Sheets

COMBINED PROPULSION AND STEERING SYSTEM FOR A MOTOR BOAT WITH AN INBOARD ENGINE

BACKGROUND OF THE INVENTION

The present invention relates to a combined propulsion and steering system for a motor boat with an inboard engine.

At present, the propulsion system used for boats having a length up to about ten meters is usually a type known as a Z-transmission. This known transmission is very complex, however and also rather delicate, and requires careful handling and use.

On boats greater than about ten or twelve meters it is usual to employ a conventional submerged shaft. These have the disadvantage of being difficult to position, and they also have relatively high energy consumption which makes them expensive and, further, presents various disadvantages at high speed.

Attempts have been made to introduce propellers with so-called "surface" screws, that is screws which are not entirely submerged in normal use, but these attempts have lead to generally mediocre results as far as the overall performance is concerned; in particular the coefficients of acceleration have been inadequate and the performance at intermediate speeds has been generally unsatisfactory. Another disadvantage of surface screws lies in the fact that boats fitted with them generally have a poor manoevrability and considerable difficulty in reversing.

OBJECTS OF THE INVENTION

A primary object of the present invention is to provide a combined propulsion and steering system for motor boats with inboard engines, which will have a low energy consumption requirement.

A further object of the invention is to provide a combined propulsion and steering system having a semi-submerged propeller screw, capable of a high performance. Another object of the invention is to obtain both of these desirable characteristics in a system of the invention both at high and low speeds of the system.

Still another object of the invention is that of avoiding unpleasant vibrations on the hull of a boat to which the system is fitted, thus contributing to a more comfortable ride.

Another object of the invention is that of providing a combined propulsion and steering system which is both efficient and manoeuvrable not only in forward movement of the boat but also in reverse motion.

A further object of the invention is to provide a propulsion and steering system which allows the transom of the boat to be substantially free and unobstructed thus contributing to a greater practicability of the vessel itself.

SUMMARY OF THE INVENTION

According to the present invention, therefore, there is provided a combined propulsion and steering system for motor boats with inboard engines, comprising:

a propeller shaft projecting from the lower part of the transom of said motor boat, a semi-submersible propeller screw carried at the end of said propeller shaft, a deflector tunnel extending over and to the sides of said propeller screw, means mounting said deflector tunnel such that it is turnable about a substantially vertical axis, the ratio between the distance from the rear of said propeller screw to the rear lower end of the hull of said motor boat, and the outer diameter of said propeller screw lying between 0.8 and 1.8.

Other features and advantages of the invention will become more apparent from the following description of a preferred embodiment thereof, made with reference to the accompanying drawings and provided purely by way of non-limitative example only.

DESCRIPTION OF THE PREFERRED EMBODIMENTS

Figure 3:
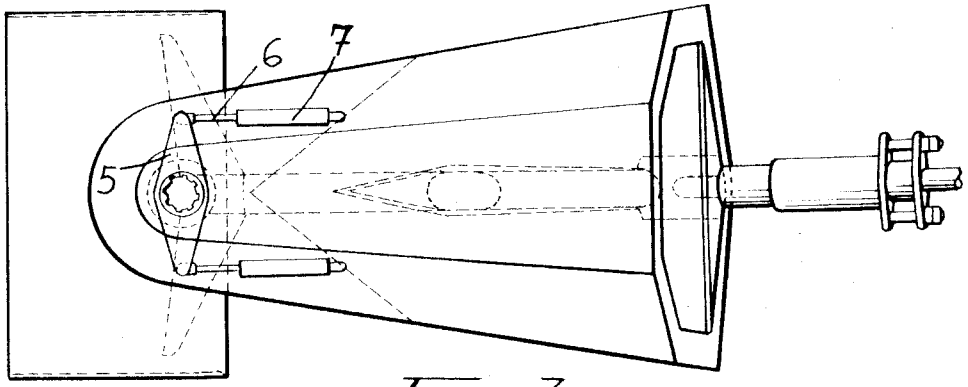
FIG. 3 is a plan view from above of the structure of FIG. 1.

Referring now to the drawings, there is shown the stern portion of a small boat having a transom 2 through which extends a propeller shaft 1 of an inboard engine (not shown). The propeller shaft 1 is, as is conventional, housed in a propeller tube 12 and extends with a slight downward inclination from the transom 2 of the boat; its free end is located substantially on the waterline. Also from the transom 2 extends a projecting bracket structure 3 which supports a vertical shaft 4 the upper end of which carries a shaped transverse arm 5 (best seen in FIG. 3) the ends of which are pivotally connected to the stems 6 of the respective fluid pressure actuators 7 which control the angular position of the shaft for purposes which will be described hereinbelow. It will be appreciated that alternative angular position control systems, including mechanical systems, may be employed for this purpose.

Figure 1:
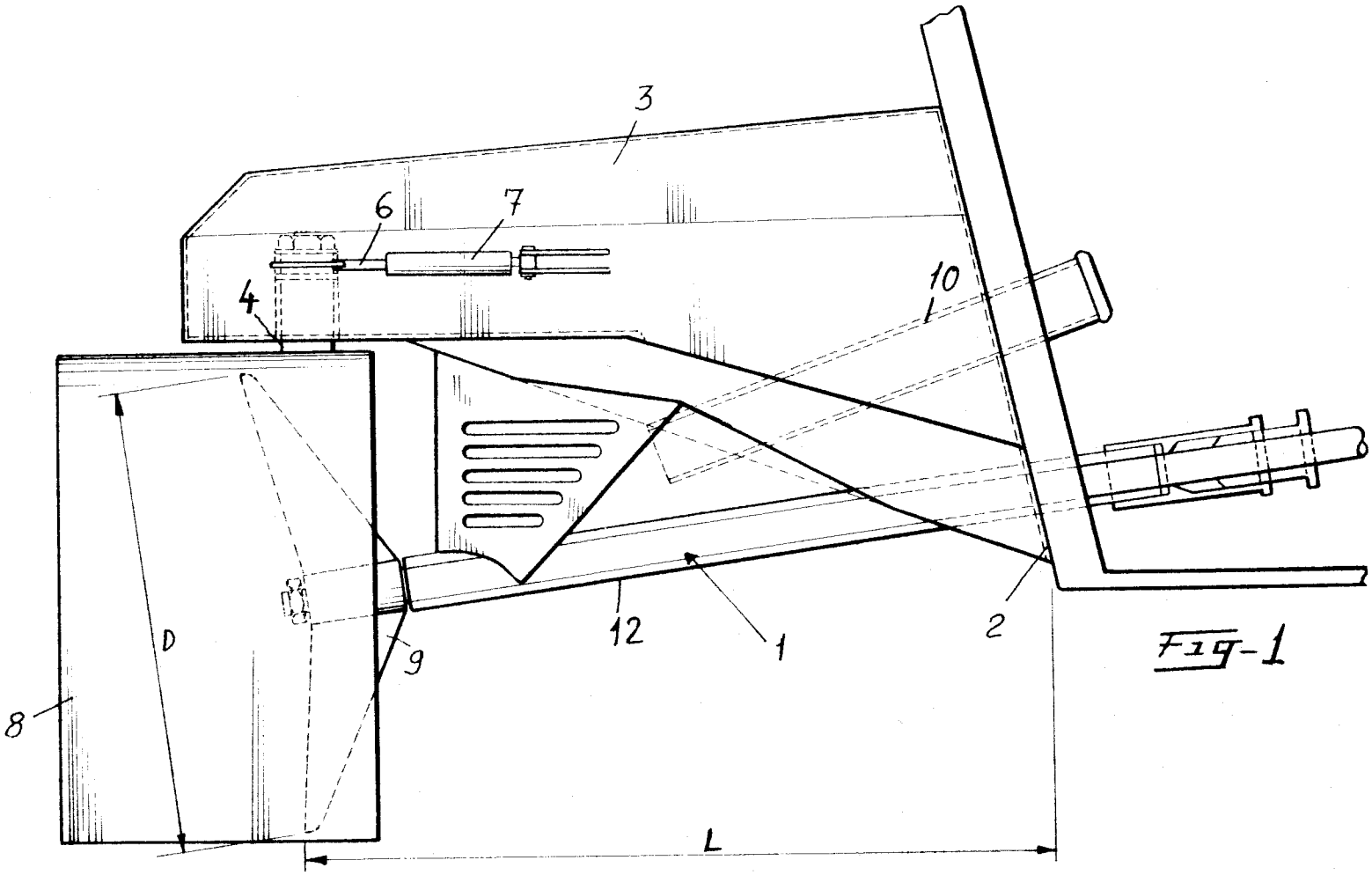
FIG. 1 is a side view of the structure of the invention.

To the lower end of the vertical shaft 4 there is fixed a deflector tunnel 8 of arch-shape, having parallel side walls and an arcuate upper portion. The side walls of the deflector tunnel dip into the water and surround a propeller screw 9 which is carried by the propeller shaft 1. The screw 9 is of the "surface" type, that is, one which is positioned on the surface such that each blade of the propeller dips into the surface as it rotates and then leaves the water as it passes over the propeller shaft to complete its revolution. Such blades have an optimum blade shape as will become clearer hereinbelow. The optimum blade shape has a diameter D which is correlated with the distance L from the centre of the lower rear face of the screw hub to the rear end of the hull, considered at that part of the transom where the propeller shaft projects through (that is the distance L measured in a horizontal plane as shown in FIG. 1). The ratio between L and D should in fact lie between 0.8 and 1.8, this range being the optimum range for the best operation of the vessel.

The transom 2 is also traversed by a duct 10 which conveys the exhaust gases from the engine and discharges them forwardly of the propeller region, thus facilitating the starting of the screw.

In the region of the propeller, in operation thereof, bubbles form in the water, which reduces the effective density of the water itself in the region in which the screw acts. This ventilation of the screw lightens the load on the motor permitting an easy acceleration thereof. The deflector tunnel serves not only to provide lateral thrust to the vessel, in place of the conventional rudder, but also retains the water spray thrown upwards by the rotation of the semi-submerged screw propeller, thereby contributing positively to the propulsion of the vessel.

Figure 6:
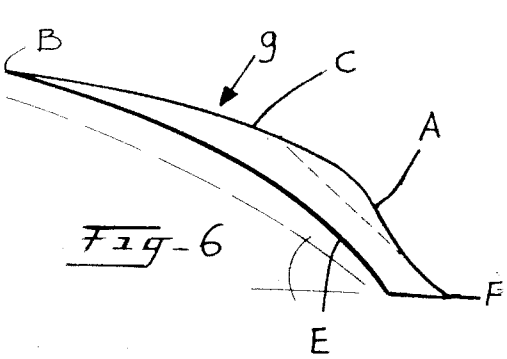
FIGS. 4, 5 and 6 are diagrammatic illustrations of possible profiles of the horizontal cross-sections of the propeller screw blades which may be utilised with the structure of the present invention.
Figure 4:
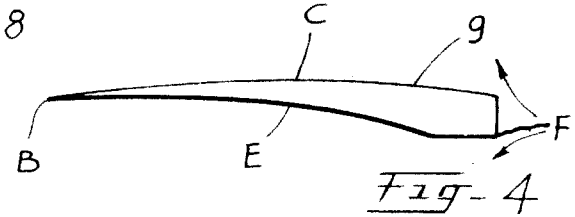
Figure 5:
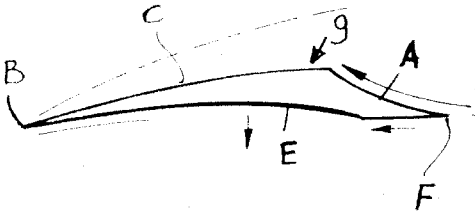
Figure 2:
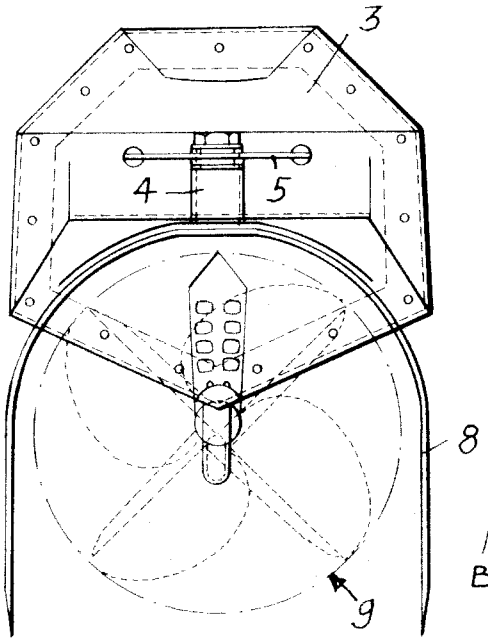
FIG. 2 is a rear view of the structure of FIG. 1.

Various different blade profiles are illustrated in FIGS. 4, 5 and 6. A conventional blade profile is illustrated in FIG. 4; such a blade is only efficient however, in forward movement, whilst in conditions of reverse operation it does not provide adequate thrust. To overcome this disadvantage a blade such as that illustrated in FIG. 5 or that illustrated in FIG. 6 may be employed. The screw propellers of FIGS. 4, 5 and 6 all have a leading edge B (with reference to the depiction of rotation for forward movement) and a trailing edge F. The conventional propeller blade of FIG. 4 is a so-called "wedge" shape in which the trailing edge is relatively thick and the blade thickness increases from the leading edge to the trailing edge. In each case the blades have a convex outer surface C and a concave opposite surface E. In the conventional wedge-shape blade of FIG. 4, the two opposite faces diverge from the leading edge B continuously to the trailing edge F of greater thickness. In the blade of FIG. 5, however, between the convex surface C and the trailing edge F there is a concave surface A, and the trailing edge F itself is also a sharp edge like the leading edge B. The concave surface E has a profile similar to that of conventional screw propellers with wedge-shape section. The advantage of the blade profile of FIG. 5 resides in an increased efficiency in reverse operation. In FIG. 5 there have been shown arrows which indicate the direction of the flow of water when the screw propeller operates in reverse, and this can be contrasted with the arrows of FIG. 4 which indicate the direction of the flow of water in reverse in the case of a screw of conventional surface profile.

FIG. 6 shows an alternative blade profile similar to that of FIG. 5, in which the region between the convex surface C and the concave surface 4 is smoothly rounded instead of having a sharp intersection line as is the case in the embodiment of FIG. 5.

The combined transmission, propulsion and steering device of the invention has the advantage of a great functionality and practicality in use deriving from significantly improved operating characteristics, particularly as far as the achievable velocity levels are concerned, as well as the possibility of obtaining a good manoeuvrability of the vessel thanks to the fact that a more efficient operation of the screw propeller in reverse is obtained with the screw blade profiles described in relation to FIGS. 5 and 6.

What is claimed is:

1. A combined propulsion and steering system for motor boat with inboard engines, comprising:

a propeller shaft projecting from the lower part of the tramsom of said motor boat, and having its free end located at the waterline of said motor boat, a semi-submersible propeller screw carried at the end of said propeller shaft, a deflector tunnel extending over and to the sides of said propeller screw, means mounting said deflector tunnel such that it is turnable about a substantially vertical axis, wherein the ratio between the distance, measured in a horizontal plane, from the center of the rear face of the screw hub to the lower rear end of the hull of said motor boat and the outer diameter of said propeller screw lying between 0.8 and 1.8.

2. A combined propulsion and steering system according to claim 1, wherein the blades of said propeller screw have, near the trailing edge, a profile including on one side a concave portion and on the other side a rectilinear portion, such as to increase the effective thrust of the propeller when running in reverse.

3. A combined propulsion and steering system according to claim 2, wherein said blades have a convex portion adjoining said concave portion, the blade portion opposite to said convex portion having a wedge cross-section profile.

* * * * *